US007810550B2

(12) United States Patent
Erhard et al.

(10) Patent No.: US 7,810,550 B2
(45) Date of Patent: Oct. 12, 2010

(54) HEATABLE METERING DEVICE FOR A HOT CHAMBER DIE-CASTING MACHINE

(75) Inventors: Norbert Erhard, Lorch (DE); Ulrich Schraegle, Remshalden (DE)

(73) Assignee: Oskar Frech GmbH & Co. KG, Schorndorf (DE)

( * ) Notice: Subject to any disclaimer, the term of this patent is extended or adjusted under 35 U.S.C. 154(b) by 471 days.

(21) Appl. No.: 11/677,792

(22) Filed: Feb. 22, 2007

(65) Prior Publication Data

US 2007/0199674 A1 Aug. 30, 2007

(30) Foreign Application Priority Data

Feb. 24, 2006 (DE) ..... 10 2006 010 084

(51) Int. Cl.
*B22D 17/04* (2006.01)
*B22D 35/00* (2006.01)

(52) U.S. Cl. ..... 164/316; 164/337

(58) Field of Classification Search ..... 164/316, 164/335, 337
See application file for complete search history.

(56) References Cited

U.S. PATENT DOCUMENTS

| | | | | |
|---|---|---|---|---|
| 4,408,651 | A * | 10/1983 | Smedley et al. | 164/316 |
| 4,595,044 | A * | 6/1986 | Caugherty et al. | 164/337 |
| 4,746,021 | A * | 5/1988 | Helmholdt et al. | 211/90.04 |
| 4,749,021 | A * | 6/1988 | Nakano | 164/316 |
| 5,960,854 | A * | 10/1999 | Fink et al. | 164/316 |
| 7,034,258 | B2 | 4/2006 | Sutorius | |
| 7,121,321 | B2 * | 10/2006 | Thibault et al. | 164/312 |
| 7,401,639 | B2 | 7/2008 | Manda | |
| 2004/0188054 | A1 | 9/2004 | Thibault et al. | |

FOREIGN PATENT DOCUMENTS

| | | |
|---|---|---|
| DE | 1 927 700 | 12/1969 |
| DE | 2 141 551 | 4/1972 |
| DE | 2 320 761 | 11/1974 |
| DE | 24 25 067 A1 | 12/1975 |
| DE | 195 31 161 C2 | 2/1997 |
| DE | 195 43 805 A1 | 5/1997 |
| DE | 102 34 532 A1 | 2/2004 |

(Continued)

OTHER PUBLICATIONS

European Examination Report dated Jul. 29, 2008 (Five (5) pages).

(Continued)

*Primary Examiner*—Kevin P Kerns
(74) *Attorney, Agent, or Firm*—Crowell & Moring LLP

(57) ABSTRACT

A metering device for a hot chamber die-casting machine includes a casting container attachable to a crucible of the hot chamber die-casting machine, a riser channel in a riser channel area, and a casting piston unit for metered conveying of melt out of the crucible via the riser channel. A heating device is provided with a flameless heating unit for active heating of at least a part of the riser channel area. The heating unit is placed inside a piston rod leadthrough bore, electrically insulated from the riser channel in a riser bore containing the riser channel, or in a heater receiving space specially provided in the casting container.

17 Claims, 5 Drawing Sheets

FOREIGN PATENT DOCUMENTS

| | | | |
|---|---|---|---|
| EP | 0 761 345 | B1 | 3/1997 |
| EP | 1 486 276 | A2 | 12/2004 |
| JP | 3-151152 | A | 6/1991 |
| JP | 5-164624 | A | 6/1993 |
| JP | 10-225753 | A | 8/1998 |
| JP | 2000-141008 | A | 5/2000 |
| JP | 2001-71105 | A | 3/2001 |
| JP | 2002-144012 | A | 5/2002 |
| JP | 2004-82458 | A | 3/2004 |
| WO | WO 03/078123 | A2 | 9/2003 |
| WO | WO 2004/078383 | A1 | 9/2004 |
| WO | WO 2005/030414 | A1 | 4/2005 |

OTHER PUBLICATIONS

German Office Action dated Sep. 5, 2006 with English translation (Four (4) pages).

Euroepan Search Report dated Nov. 27, 2007 with English translation of relevant portion (Seven (7) pages).

English Translation of Japanese Office Action dated Nov. 10, 2009 (Six (6) pages).

Notice of Reason for Rejection dated Apr. 13, 2010 (Seven (7) pages).

* cited by examiner 21
12b
12a
22
9
2b
12
2
7
6
5
23
3
8
11a
2c
20
9a
4
4a
10
11
1
8a
2a

HEATABLE METERING DEVICE FOR A HOT CHAMBER DIE-CASTING MACHINE

This application claims the priority of German Application No. 10 2006 010 084.0, filed Feb. 24, 2006, the disclosure of which is expressly incorporated by reference herein.

BACKGROUND AND SUMMARY OF THE INVENTION

The invention relates to a metering device for a hot chamber die-casting machine, where the metering device includes a casting container attachable to a crucible of the hot chamber die-casting machine and having a riser channel in a riser channel area and a casting piston unit for metered conveying of melt out of the crucible via the riser channel, and a heating device with a flameless heating unit for active heating of at least a part of the riser channel area.

In the hot chamber casting process, the casting container and a casting piston of the casting piston unit are inside the liquid casting material melted in the crucible of a corresponding melting furnace, whereby the efficiency is in general considerably higher than with the cold chamber casting process. It is, for example, used in zinc and magnesium die-casting, where magnesium as the casting material has a processing temperature of typically between around 630° C. and around 660° C. depending on the alloy.

In order to prevent cooling-down problems with the stated high processing temperatures, for example in magnesium die-casting, it is known for hot chamber die-casting machines to actively heat the casting container and a nozzle that is usually attached thereto and that leads to a mould. An earlier proposal provides in this respect for gas heating of the nozzle and of the casting container at least in a connection area to which the nozzle is attached. This open gas flame heater is, however, problematic for safety reasons alone. In addition, it is difficult to heat the nozzle with a constant temperature using this technique, which can lead to nozzle deformations, and the expensive material of the nozzle and the casting container is put under relatively heavy strain by the gas flame heater.

Various alternatives to gas flame heating have, therefore, already been proposed, in particular electric resistance heaters and electric induction heaters. For example, the German laid-open publication DE 21 41 551 describes a direct electric resistance heater of a riser channel and of an adjacent nozzle, in which the riser channel and the nozzle are formed by a metallic riser channel pipe or nozzle pipe which themselves act as resistance heating elements and are surrounded by a heat-insulating material. This, however, has the drawback that the conveyed molten material is, in general, also electrically conducting and hence the heat input by the electric heater greatly fluctuates depending on the degree to which the melt fills the riser channel pipe and the nozzle pipe, so that controlled air cooling of the nozzle is provided there to prevent overheating.

In a hot chamber die-casting machine disclosed in the laid-open publication DE 24 25 067 A1, the metering device with casting container and nozzle is located completely outside the crucible, into which a filling chamber is inserted with which the metering device is connected via an associated connecting riser pipe. The filling chamber may be closed off from the crucible using a valve. By introducing an inert gas under pressure, the melt is conveyed via the connecting riser pipe into the casting container. The casting container, the nozzle, that part of the connecting riser pipe which is outside the crucible, and an overflow pipe leading from the casting container back into the crucible, are heatable by an enclosing electric induction heater.

The patent publication EP 0 761 345 B1 describes a further hot chamber die-casting machine with a generic metering device. In the arrangement therein, an inductive heating device for the nozzle and for a connection area of the casting container is provided, the inductors of which include externally insulated pipes which can be subjected to medium frequency or to a frequency around the lower high-frequency limit and through which air can flow. There, the casting container is inserted from above with the aid of a cover into the crucible, i.e. it is located with a lower part inside the crucible and with a top part containing the casting piston drive and the connection area for the nozzle outside the crucible. To permit heating of the casting container as close as possible above the crucible, the inductive heating device optionally contains an additional annular inductor placed around the casting container neck directly above the crucible cover. For forced cooling of the induction heater, an air cooling system is used instead of water cooling, which is safety-critical for example in magnesium die-casting. To do so, the inductors require sufficient installation space that cannot be reduced at will. A further problem with heating devices of the inductive type is the occurrence of stray fields, which can lead to unwelcome heating-up of other adjacent components, for example areas of the mould in the vicinity of the heated nozzle.

The technical problem underlying the invention is to provide a metering device of the type mentioned at the outset, by which the mentioned difficulties of the prior art are reduced or eliminated and which permits, in particular, reliable and safe heating of the casting container in the riser channel area outside the melting bath in the crucible using a heating device that may have a comparatively small construction.

The invention solves this problem by providing a metering device for a hot chamber die-casting machine, including a casting container attachable to a crucible of the hot chamber die-casting machine and having a riser channel in a riser channel area and a casting piston unit for metered conveying of melt out of the crucible via the riser channel, and a heating device with a flameless heating unit for active heating of at least a part of the riser channel area. The heating unit is placed in either a piston rod lead through bore through which a piston rod of the casting piston is passed, containing the riser channel and electrically insulated from the riser channel, in a riser bore or in a heater receiving space specially provided in the casting container. With this metering device, the heating device includes a flameless heating unit placed (i) inside a piston rod leadthrough bore through which a piston rod of the casting piston unit is passed, (ii) electrically insulated from the riser channel in a riser channel bore containing the riser channel, or (iii) in a heater receiving space specially provided in the casting container. The term "bore" must here be generally understood as an aperture of any cross-section, not necessarily circular.

The use of a flameless heating unit avoids the difficulties of heater types having a naked flame. The positioning locations in accordance with the invention for the heating unit permit an internal and active heating of at least a part of the riser channel area of the casting container that contains the riser channel. This permits, compared with a heater that is only on the outside, an effective and even heating of the riser channel if required from the height of the bath level, i.e. filling level, of the melting bath inside the crucible, or slightly above it. In a first positioning variant, the piston rod leadthrough bore provided in any case for passing through the casting piston rod is used, and in this case receives the heating unit. Since the piston rod leadthrough bore extends through the casting container to underneath the bath level, the heating unit may be arranged at any required depth inside the casting container. This can, in the case of a system type in which the casting container is inserted from above into the crucible so that a lower part is inside the crucible and a top part with casting piston drive and nozzle connection area is outside the crucible, preferably be a depth up to about the crucible cover or up to a normal or maximum bath level of the melt inside the crucible.

In a second positioning variant, the heating unit is inserted into the riser channel bore forming the riser channel, where it is electrically insulated from the typically metallic melt conveyed in the riser channel. This prevents fluctuations in the heating capacity when an electric resistance heating unit is selected as the heating unit. In this case too, the heating unit may be positioned at any height relative to the bath level of the melt inside the crucible.

In a third positioning variant, the heating unit is located inside a heater receiving space additionally provided for this purpose in the casting container. The height and lateral position of the latter may be selected such that the inserted heating unit heats the riser channel effectively and evenly in the required manner, in particular at or just above the melting bath level. To do so, the heater receiving space can extend, for example, at a slight distance from the riser channel and parallel or angled thereto as far as a required depth, e.g. in the case of the type with the casting container inserted into the crucible from above up to the normal or maximum bath level of the melt inside the crucible, or up to about the top edge of the crucible or to the height of a crucible cover.

In a particularly advantageous embodiment of the invention, the heating unit is an electric resistance heating unit. An electric resistance heating unit of this type can, if required, be built relatively small, i.e. it requires relatively little installation space thus permitting a particularly compact design of the metering device. The heating capacity of the electric resistance heating unit can be selectively controlled such that overheating is avoided without the absolute need for cooling ducts, which require a considerable space requirement.

In a further embodiment, the electric resistance heating unit is of a hollow-cylinder shape with a heating cylinder that has on its cylinder casing an electric heating conductor structure and is coaxially inserted into the appropriate bore or receiving space, which is designed therein as a heater bore. A resistance heating unit of this type can, firstly, be achieved at relatively low expense and, secondly, permits required, effective and constant riser channel heating. To do so, the electric heating conductor structure can be designed flexibly and suitably, for example for different heating capacities in various sections due to a correspondingly different density in the arrangement of the heating conductors and/or due to heating conductor sections with different heating conductor cross-sections. If required, the heating conductor structure may contain one or more separately controllable heating circuits. In operation, the heating cylinder can, due to the thermal expansion generally occurring, be in firm contact with or press against the adjacent bore inner wall, which contributes to its firm positioning and ensures, particularly in cases with heat transfer radially outwards, to a good heat transmission to the adjacent casting container area.

In a further embodiment, the cylinder casing of the heating cylinder contains a heat-conducting support sleeve which supports the heating conductor structure in an electrically insulating manner. The heat generated by the heating conductor structure is in this way transferred to the support sleeve and injected by the latter in an even distribution into the adjacent casting container area or riser channel area. In a further embodiment, the support sleeve is provided with thermal insulation on its inner or outer side, which improves the heat transfer into the adjacent casting container or riser channel area on the respective other side of the sleeve facing away from the thermal insulation. In addition, undesirable high temperatures on the thermally insulated side can be reliably prevented. For example, undesirable high temperatures in the piston rod leadthrough bore and for the passed-through casting piston rod, when the heating unit has been inserted into the piston rod leadthrough bore, are prevented by an internal thermal insulation of the support sleeve. In a further embodiment, an insulating sleeve made of thermally insulating material abuts against the support sleeve as a thermal insulation to form a hollow insulation space, e.g. in the form of air cushions.

A further embodiment of the invention relates to a system type where the casting container, when attached to the crucible, is inside the crucible with a crucible-side part and outside the crucible with a top part, e.g. by inserting or mounting the metering device into or onto the crucible from above. The heating cylinder extends in this embodiment of the invention in the top part as far as the crucible-side part of the casting container or at least partially inside the crucible-side casting container part. Additionally or alternatively, the heating cylinder extends in the top part of the casting container on its side facing away from the crucible at least up to the maximum height distance of the riser channel from the crucible-side part of the casting container, i.e. it extends at least as far as the riser channel away from the crucible. The latter contributes to active heating of the riser channel in its section further away from the crucible as far as the opening into the attached nozzle, while the former permits riser channel heating at or just above the bath level of the melt inside the crucible.

In an advantageously designed embodiment of the invention, the bore receiving the heating cylinder is of a conical form, and the heating cylinder is inserted with the aid of an exteriorly conical shaped adapter sleeve, on the inside of which it is arranged, into the appropriate bore. The conical shape facilitates the removal of the adapter sleeve with the heating cylinder from the bore for maintenance or replacement purposes. In a further embodiment, the tapered bore is formed by an internally tapered insertion sleeve that is of cylindrical form on the outside and that is inserted with close fit into a cylindrical receiving bore of the casting container. In this way, the casting container itself does not need to be produced with a conical bore; it is sufficient to provide the cylindrical receiving bore using simpler production technology.

In a further advantageous embodiment of the invention, the heating device contains several flameless heating units, of which one each is placed in the piston rod leadthrough bore and/or the riser channel bore and/or one or more heater receiving spaces provided specially in the casting container. Placement in this way of several heating units at various points inside the casting container with thermal contact to the riser channel can improve the evenness of the heating of the riser channel area of the casting container and reduce the temperature gradients in the heated casting container area. If required, it is also possible to place several heating units in one of the bores or heater receiving spaces at various points along the riser channel area to be heated of the casting container. It goes without saying that some or all of these heating units may each be formed by an electric resistance heating unit, for example in the form of the heating cylinder mentioned.

In another embodiment of the invention, the heating device includes a further flameless heating unit with which a nozzle connection area of the casting container and/or a nozzle attachable thereto can be additionally heated from the outside. In this case too, an electric resistance heating unit in the form of a heating cylinder laid around the connection area and/or the nozzle with the electric heating conductor structure can be used. This favors a compact design of the connection area and of the nozzle, since overheating can be prevented by suitable control of the electric heating capacity and hence voluminous cooling ducts may be dispensed with.

Other objects, advantages and novel features of the present invention will become apparent from the following detailed description of the invention when considered in conjunction with the accompanying drawings.

DETAILED DESCRIPTION OF THE DRAWINGS

Figure 1:
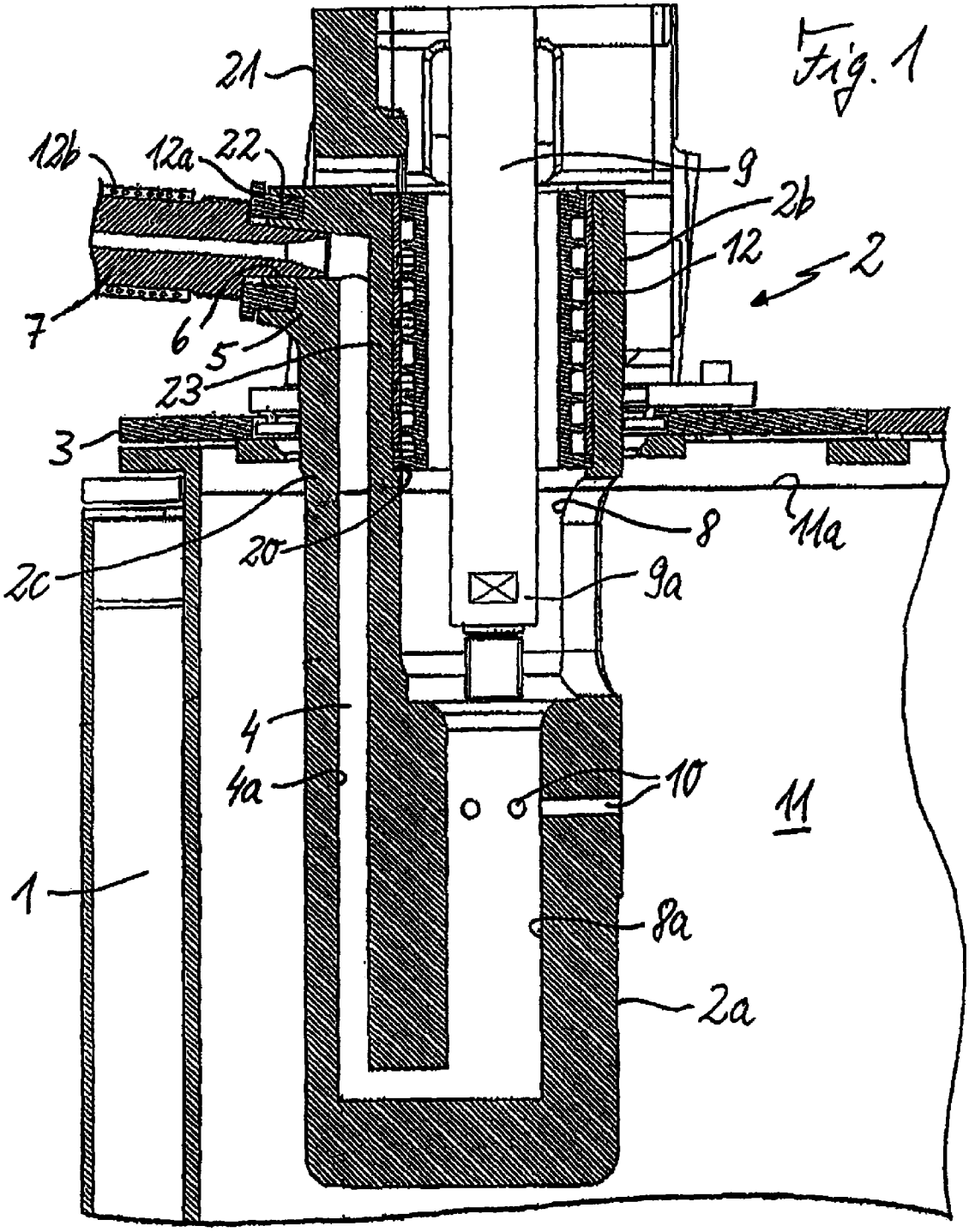
FIG. 1 is part of a longitudinal sectional view of a metering device for a hot chamber die-casting machine with a casting container inserted into a crucible with attached nozzle and internal electric heating cylinders.

FIG. 1 illustrates part of a metering device of a hot chamber die-casting machine usable, for example, for casting magnesium parts. The casting material, such as liquid magnesium at processing temperatures of around 630° C. to 680° C., is usually melted by a melting furnace (not shown in detail) in an associated crucible 1 (shown only partly here). A casting container 2 extending through a crucible cover 3 and sealed off from the latter is inserted into the crucible 1 from the top. The casting container 2 has a casting container body, which in the condition as shown attached to the crucible 1, projects with a lower part 2*a* into the crucible 1 while it is outside the latter with a top part 2*b*, i.e. in this example above the crucible 1. In a riser channel area 2*c* of the casting container 2 (shown on the left in FIG. 1), a riser bore 4*a* defining a riser channel 4 is formed in a manner known per se and extends from the lower casting container part 2*a* upwards out of the crucible 1 into the casting container top part 2*b*. There, the riser bore 4*a* ends with an angled outward-tapering mouthpiece 6 provided in a nozzle connection area 5 at the upper end of the riser channel area 2*c* of the casting container 2. A nozzle (shown only partially here) is inserted into the mouthpiece 6 and extends with its mouthpiece, not shown, in the usual manner up to a gate area of a mould.

Parallel to the off-center arranged riser bore 4, a piston rod leadthrough bore 8 is formed approximately centrally in the substantially cylindrical casting container 2, through which bore a piston rod 9 of a casting piston/casting cylinder unit is passed in a manner known per se. The piston rod 9 is driven by a conventional casting piston drive, not shown, which like the casting container 2 is held on a cross-piece of which FIG. 1 shows only a lower part 21. At its other end, the lower one in FIG. 1, the piston rod 9 has a casting piston 9*a*. The casting piston 9*a* corresponds in a precise fit to a narrower lower part 8*a* of the piston rod leadthrough bore 8, which is in fluid connection with the crucible interior via radial melt inlet openings 10 in the lower casting container part 2*a*. Melt 11 prepared in the crucible can, therefore, when the casting piston 9*a* is raised enter the casting cylinder of the casting piston/casting cylinder unit formed by the lower part 8*a* of the piston rod leadthrough bore, and by pressing down the casting piston 9*a* melt is conveyed via the riser channel 4 formed by the riser bore 4*a* to the nozzle 7 and, from there in metered fashion into the mould as soon as the casting piston 9*a* falls below the level of the inlet openings 10.

Above the section 8*a* acting as the casting cylinder, the piston rod leadthrough bore 8 has a larger diameter, as shown, so that in this area an annular gap remains between the inside of the bore and the piston rod 9 passing through it. Characteristically, an electric resistance unit in the form of an electric heating cylinder 12 is inserted coaxially into this annular gap in the case of the metering device of FIG. 1. As shown, the heating cylinder 12 extends axially downwards to below the level of the crucible cover 3 into the crucible 1 and only ends just above a normal or maximum melting bath level 11*a*, i.e. the normal or maximum filling level of the crucible 1 with the molten casting material 11. The heating cylinder 12 extends upwards to about the top edge of the casting container 2 and, hence, vertically beyond the riser channel 4 and its conical mouthpiece opening 6 with the inserted nozzle 7.

In this way, the casting container may be effectively and evenly heated by the electric resistance heating unit 12 actively, from an area still inside the crucible 1 at the same height or just above the normal or maximum bath level 11*a* of the melt 11 to above the mouthpiece end 6 of the riser channel 4. This permits, in particular, effective and even heating of the entire area of the riser channel 4 above the melting bath level 11*a* and especially outside the crucible 1 up to the mouthpiece 6, this area being particularly critical with regard to undesirable melt cooling. The heating cylinder 12 is here located relatively close to this critical upper section of the riser channel 4, where a surrounding cylindrical casting container section 23, on which the nozzle connection area 5 is integrally provided, is formed of, like the entire casting container body, good thermally conducting and metallic material and, therefore, ensures good heat transmission from the heating cylinder 12 to the riser channel 4.

This implementation of active internal heating of the casting container head 2*b* in this critical area can, therefore, generally be achieved much more effectively and with a more compact design than an outside heater, which is already rendered more difficult by the more complex external geometry of the casting container head 2*b* in the area of the attached nozzle 7 in particular. In an advantageous fashion, the already provided annular gap between the piston rod and the wall of the piston rod leadthrough bore 8 is used to accommodate the heating cylinder 12 so that the external dimensions of the casting container 2 are not altered by this heating unit 12.

Figure 2:
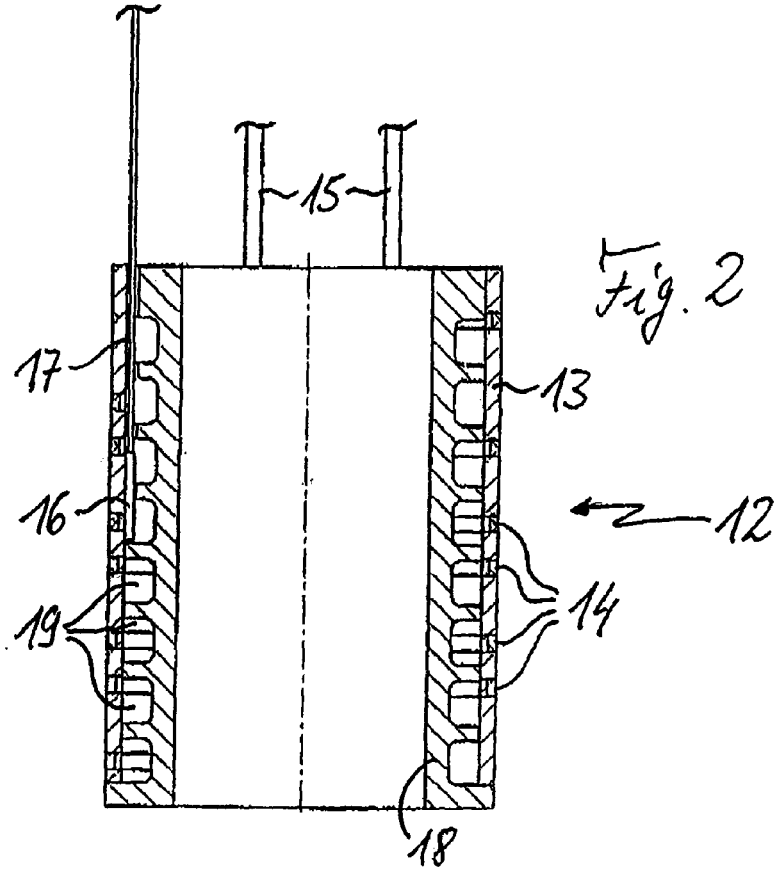
FIG. 2 is a longitudinal sectional view of a heating cylinder inserted into a piston rod leadthrough bore of the casting container in FIG. 1.
Figure 3:
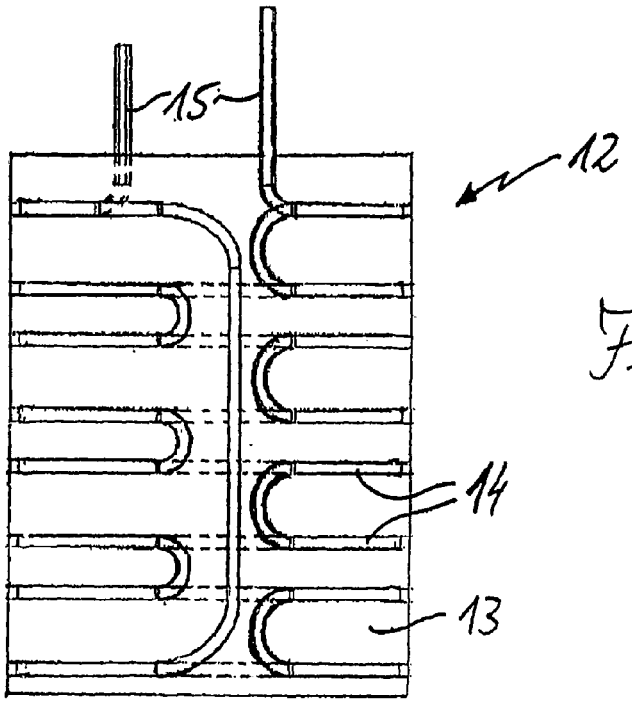
FIG. 3 is a side view of the heating cylinder of FIG. 2.

FIGS. 2 and 3 show, individually, the electric heating cylinders 12 used in FIG. 1 in a longitudinal sectional view and side view. Here, it can be seen that the heating cylinder 12 is designed as a heating cartridge with a cylindrical support sleeve 13 made of a thermally conducting material into which a meandering heating conductor structure 14 is accommodated in appropriate exterior recesses of the support sleeve 13 and also flush with the exterior surface. In the example shown, the heating conductor structure is designed as a single-circuit with a single meandering heating conductor current loop. The route is discernible from FIG. 3. A suitable heating voltage or a suitable heating current can be applied using two associated connections 15. In alternative embodiments, the heating conductor structure is multi-circuit one, i.e. it then contains several individual heating circuits that can be controlled separately. Hence, it is possible if required to control the heating capacity with local variation. To that end, it is also possible in alternative embodiments to implement the heating conductor structure with locally differing densities of the heating conductor sections or with heating conductor sections that can have different conductor cross-sections in various areas.

In the application in FIG. 1, the heat generated by the heating cylinder 12 is to be radiated radially outwards into the adjacent cylinder section 23 of the casting container 2. To assist this radially outward heat transmission, and to prevent any unnecessary or excessive radially inward thermal radiation from the heating cylinder 12, the support sleeve 13 is provided on its inside with thermal insulation in the form of an insulating sleeve 18. The insulating sleeve 18 includes a thermally insulating material and has, additionally, on the outside recesses so that thermally insulating air cushions 19 are formed between the insulating sleeve 18 and the support sleeve 13. When the heating cylinder 12 is inserted into the piston rod leadthrough bore 8 in accordance with FIG. 1, this dependably prevents excessive temperatures inside the piston rod leadthrough bore 8 and hence also for the piston rod 9.

To generate the required heating capacity, the heating cylinder 12 is supplied from a conventional electric power source and an associated control device (not shown) with controllable power output. For regulation and control of the heating capacity of the heating cylinder 12, its temperature is recorded by a temperature sensor 16, which is integrated with an associated power lead 17 into the heating cylinder 12, as can be seen in FIG. 2 between the support sleeve 13 and its internal thermal insulation 18.

In the example in FIG. 1, the heating cylinder 12 with its crucible-side end face contacts a ring collar 20 formed by an appropriate diameter change of the piston rod leadthrough bore 8, which extends downwards from there with a slightly smaller diameter than at the level of the inserted heating cylinder 12. In this way, a labyrinth seal-like splash guard is provided, which together with the support sleeve 13 and the insulating sleeve 18, protects the heating conductor structure of the heating cylinder 12 from any melt splashes if the latter splashes upwards out of the casting cylinder area 8*a* or the inlet opening area 10 during operation.

Figure 4:
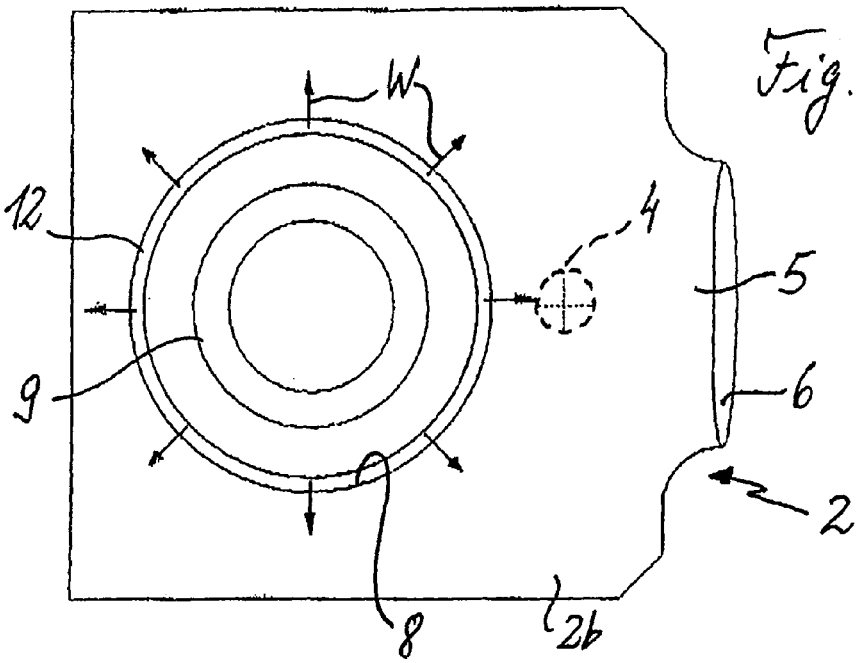
FIG. 4 is a plan view onto a top part of the casting container of FIG. 1.

FIG. 4 illustrates, in a diagrammatic plan view onto the casting container head 2*b* without the nozzle attached to the connection area 5, the radially outward oriented radiation of heat W generated by the heating cylinder 12, which is coupled with appropriate evenness into the casting container head 2*b*, which typically is formed of heat-resistant steel or other temperature-resistant material having good thermal conductivity. Due to the thermal expansion, the heating cylinder 12 presses during active heating operation firmly against the inner wall of the piston rod leadthrough bore 8, which favors the heat transmission into the casting container head 2*b*. The casting container head 2*b* is evenly heated as a result, so that effective and active heating is provided to match the riser channel area of the casting container 2 in the critical section above the crucible 1. The lateral position of the riser channel 4 between the piston rod leadthrough bore 8 and the connection area 5 or the mouthpiece 6 is indicated by dashed lines in FIG. 4. Due to the even heating of the casting container head 2*b*, undesirable high temperature gradients there can be prevented.

If required, the heating of the casting container head 2*b* can be optimized by setting a different heating capacity of the heating cylinder 12 depending on the location. For example, to do so the heating cylinder 12 can, on its side facing the riser channel 4, be designed for a higher heating capacity than on its side facing away from the riser channel 4. This can, for example, be achieved by laying the heating conductors on the side facing the riser channel closer together, i.e. with a greater density, than on the side facing away from the riser channel 4, or by selecting different conductor cross-sections. It can also be provided that the heating capacity of the heating cylinder 12 is varied in the axial direction, for example by setting a higher heating capacity as the distance from the crucible 1 increases. This too can be achieved by a correspondingly different density in the laying of the heating conductors and/or by selecting different conductor cross-sections.

For further optimization of internal active heating, in particular of the critical upper part of the riser channel area 2*c*, a second internal electrical heating unit 12*a* is provided in the nozzle connection area 5 of the casting container 2 of FIG. 1. To that end, an annular groove 22 of sufficient depth is provided at the end face in the connection area 5 at some radial distance from and around the opening riser channel mouthpiece 6, into which groove is inserted the second heating unit 12*a*, also designed as a heating cylinder. In other words, a separate heater receiving space is created in the nozzle connection area 5 of the casting container head 2*b* by the annular groove 22, into which the second heating cylinder 12*a* is inserted.

The second heating cylinder 12*a* can match in its shape the type of the first heating cylinder 12 inserted into the piston rod leadthrough bore 8, i.e. provided on its outside and/or inside on a support casing with an electric heating conductor structure and optionally, on the casing side facing away from the heating conductor structure, with thermal insulation. Alternatively, the second heating cylinder 12*a* can also be implemented by a different heating cartridge of a conventional type. The second heating cylinder 12*a* is preferably designed for thermal radiation radially inwards and possibly additionally on the inside end face. It achieves effective active heating especially of the nozzle connection area 5 in the area of the riser channel mouthpiece 6 and of the entry area inserted into this for the attached nozzle 7.

For a further heating option, additional outside heating of the nozzle 7 by a third heating unit 12*b* is provided in the embodiment of FIG. 1, and is also designed as an electric resistance heating unit in the form of a heating cylinder arranged around the nozzle circumference. The axial length of this third heating cylinder 12*b* can be freely selected depending on the required heating length of the nozzle 7. The third heating cylinder 12*b* can also correspond in its design to the first heating cylinder 12 or be of a different and conventional type not explained in detail here. In any event, the electric heater of the nozzle 7 has the advantage, compared for example to an induction heater, that it does not require forced cooling and can be built more compactly, so that overall the diameter of the nozzle 7 provided with the outside heating cylinder 12*b* can be kept relatively low. In addition, stray fields, as occur in induction heaters, are avoided in the exclusively electric heating of the casting container 2 and of the nozzle 7. Alternatively to internal mouthpiece heating by the second heating unit 12*a*, external mouthpiece heating by a heating unit surrounding the nozzle connection area 5 can be provided, for example in the manner of the external nozzle unit 12*b*.

With the aid of three electric heating units 12, 12*a*, 12*b*, sufficient and even active heating of the melt conveying line from the crucible 1 up to and, if necessary, inclusive of the nozzle 7 can be assured. The first heating cylinder 12 inserted into the piston rod leadthrough bore 8 already ensures even heating of the upper section of the riser channel 4 from the bath level 11*a* of the melt 11 in the crucible 1 as far as the angled mouthpiece area 6, which in turn is additionally heated by the second heating cylinder 12*a* surrounding it. The nozzle line can be heated over the required length by the third heating cylinder 12*b* surrounding it. It is, of course, possible for the three heating units 12, 12*a*, 12*b* to be suitably matched to one another in their heating capacity if necessary, for which purpose they can be attached in the usual way to a conventional unit, not shown, for regulation or control of the electric heating capacity. It is also understood that in alternative embodiments and depending on the application, only the first heating cylinder 12 in the piston rod leadthrough bore 8 or only the second heating cylinder 12*a* in the nozzle connection area 5 can be provided, with or without the additional external nozzle heater 12*b*.

Figure 5:
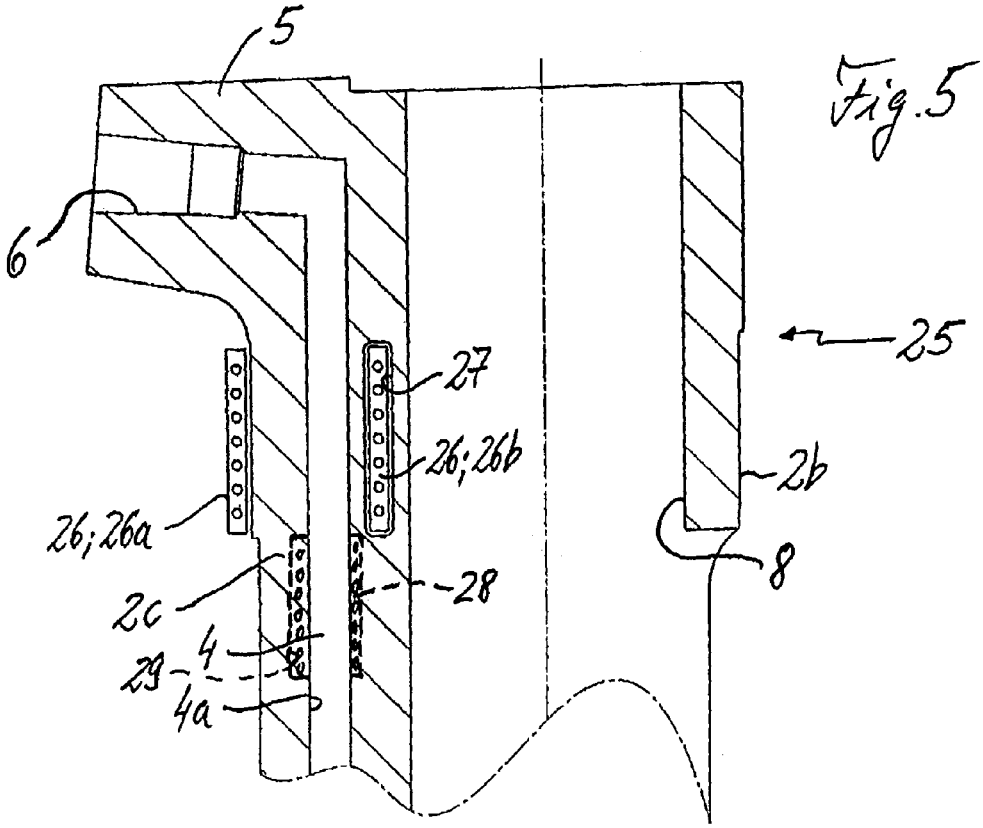
FIG. 5 is a detailed sectional view of a variant of the casting container of FIG. 1 with an electric heating cylinder enclosing a riser channel section.

FIG. 5 shows as a variant of the embodiment of FIG. 1 a further advantageous inner electrical heating option for an appropriately modified casting container 25, where for the sake of clarity the same reference numbers are used as in FIG. 1 for identical or functionally equivalent elements, and to which reference can insofar be made to the above description. The casting container 25 is shown in FIG. 5 only with a section of its top part 2*b* that is of interest here and that includes the nozzle connection area 5 without the nozzle inserted.

In the casting container 25 in FIG. 5, an electric heating unit in the form of a heating cylinder 26 is provided that surrounds the riser channel 4 in a vertical section shortly before the transition to the angled mouthpiece area 6 at a small radial distance. To do so, a vertical longitudinal slot opening 27 in an arc shape, for example approximately semicircular shape, is provided in the appropriate section of the riser channel area 2*c* of the casting container 25, and acts as a heater receiving space into which is inserted a part-shell 26*b* of the heating cylinder 26, which is composed of two part-shells 26*a*, 26*b*. The other part-shell 26*a*, is in the example shown, positioned from the outside against the riser channel area 2*c*. In particular, the two part-shells 26*a*, 26*b* can each be a half-shell. It is, of course, possible for the axial length of the heating cylinder 26 to be selected as required. Since it is placed comparatively close to the riser channel 4, it is possible with this heating cylinder 26 to effect selective heating of the riser channel 4 in the appropriate section. If required, heating with the heating cylinder 26 in accordance with FIG. 5 can be combined with heating by one or more of the three heating units 12, 12*a*, 12*b* shown in FIG. 1.

A further alternative electric heater close to the riser channel is indicated in FIG. 5 by dashed lines. Here, an electric heating cylinder 28 is inserted into the riser bore 4*a* itself that forms the riser channel 4, for example in an appropriate internal recess 29 thereof. Alternatively, a heating cylinder inserted into the riser bore itself can be part of a push-in sleeve that is inserted into the riser bore 4*a* and forms the riser channel 4 in the appropriate section. It is understood that the electric heating conductor structure of the heating cylinder is electrically insulated from the interior of the riser bore and hence from the melt being conveyed there.

FIGS. 6 to 9 illustrate a further variant of an electrically heatable casting container 30 for an appropriate metering device of a hot chamber die-casting machine, where the casting container 30 is here shown only with a casting container top part 30*a* containing the heating system. Otherwise, the casting container 30 and the associated metering device are of the usual type, e.g. the type corresponding to the embodiment of FIG. 1. This casting container 30 thus also has an approximately central axial piston rod leadthrough bore 31 and an off-center riser channel, which is not discernible in the views of FIGS. 6 to 9, that opens in a nozzle connection area 32 with an angled mouthpiece 33.

For active heating of the casting container head 30*a*, in particular in the vicinity of the riser channel, four electric resistance heating units 34*a*, 34*b*, 34*c*, 34*d* are provided in this embodiment, and are inserted into heater bores specifically provided for the purpose as blind holes from the top into the casting container head 30*a*.

Figure 6:
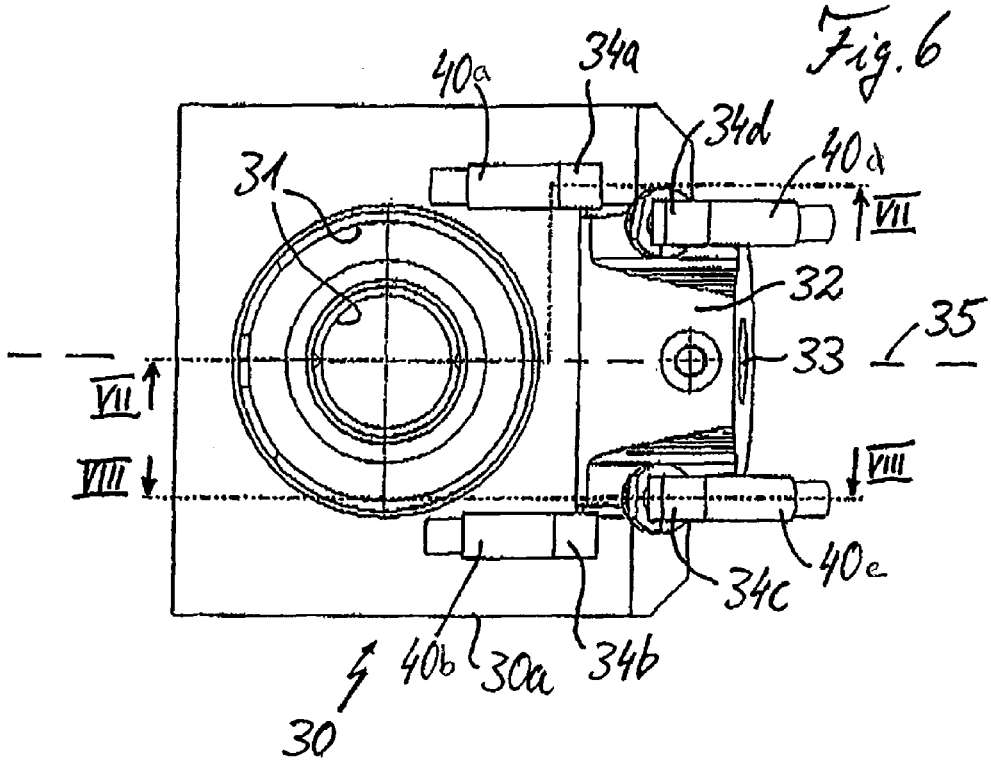
FIG. 6 is a plan view onto a top part of a further variant of the casting container of FIG. 1, with several electric heating cylinders inserted into separate heater bores.
Figure 7:
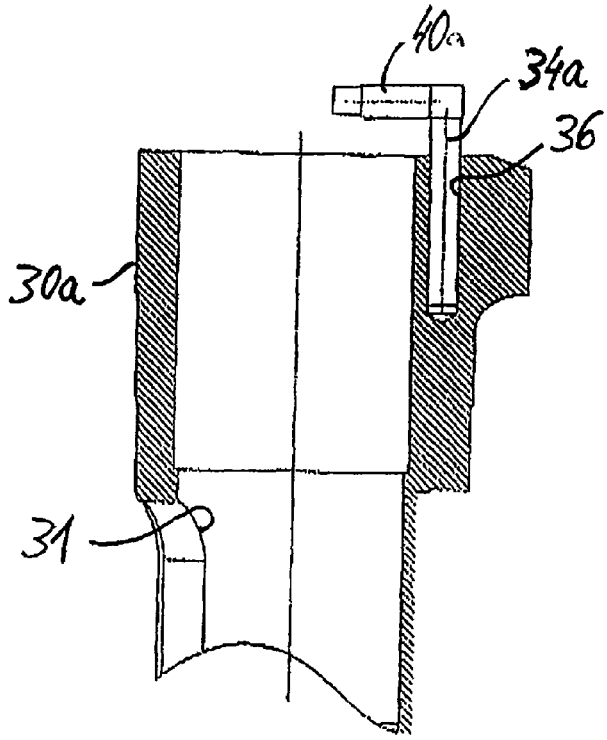
FIG. 7 is a longitudinal sectional view taken along the line VII-VII in FIG. 6.

As can be seen in FIG. 6 in particular, the four heating units 34*a* to 34*d* are arranged symmetrically to a longitudinal symmetry axis 35 of the casting container 30. Two heating units 34*c*, 34*d* are located each on one side of the nozzle connection area 32, while the two other heating units 34*a*, 34*b* are arranged somewhat outwards and offset in the direction of the piston rod leadthrough bore 31, as shown. The two latter heating units 34*a*, 34*b* are inserted vertically in the form of heating cylinders or heating cartridges into the corresponding vertical heater bore 36, as can be seen from the sectional drawing in FIG. 7 for the heating cartridge 34*a*. The two other heating units 34*c*, 34*d* are inserted as heating cylinders or heating cartridges into heater bores 37 running obliquely downwards and internally, as can be seen in the sectional drawing in FIG. 8 for the heating cartridge 34*c*.

Figure 8:
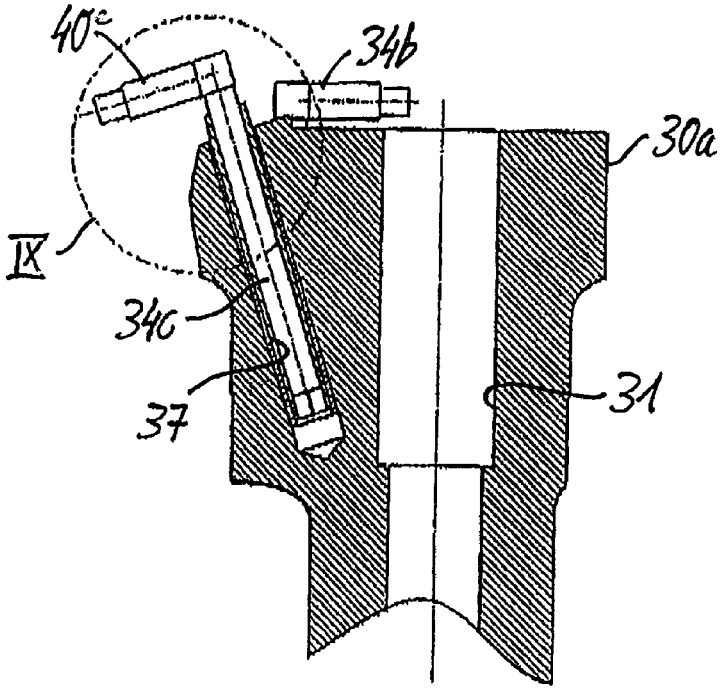
FIG. 8 is a longitudinal sectional view taken along the line VIII-VIII in FIG. 6.
Figure 9:
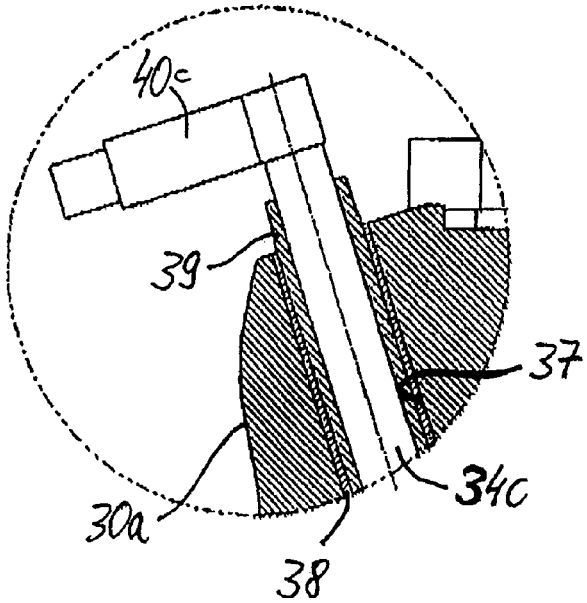
FIG. 9 is a detailed view of an area IX of FIG. 8.

FIGS. 8 and 9 furthermore show in more detail an advantageous way of accommodating the respective heating cartridge into its associated heater bore using the example of the heating cartridge 34*c* inserted into the heater bore 37. With this implementation, the heater bore 37 has a cylindrical design, and an externally cylindrical but internally conical insertion sleeve 38 is fitted, for example shrunk, into the heater bore 37. The heating cartridge 34*c*, which is of externally cylindrical form, is inserted by means of an externally conical and internally cylindrical adapter sleeve 39 into the internal cone provided by the insertion sleeve 38 and tapering from the outside to the inside. To do so, the external cone of the adapter sleeve 39 is selected to match the internal cone of the insertion sleeve 38.

This design of the receiver for the respective heating cartridge permits, even after lengthy use, a problem-free extraction of the heating cartridge removable only in this way from its heater bore designed as a blind hole, for maintenance or replacement purposes. Even after lengthy thermal stress under normal die-casting conditions and at the appropriate heating temperatures, the adapter sleeve 39 with the heating cartridge 34*c* held inside it can be removed, thanks to its external cones tapering outwards from inside to outside, out of the insertion sleeve 38 with its corresponding internal cone without these parts becoming inseparably jammed. This can also be further enhanced if required by the adapter sleeve 39 being made from a material with good sliding properties, in addition to good thermal conductivity that is required to assure a good heat transmission from the heating cartridge 34*c* into the material of the casting container head 30*a*. A favorable material for these requirements of the adapter sleeve 39 is bronze, for example. The use of the externally cylindrical and internally conical insertion sleeve 38 has advantages in production, since the heater bore 37 itself can be provided in cylindrical form in the casting container head 30*a* and does not have to be designed conical at greater expense.

The four heating cartridges 34*a* to 34*d* permit, due to their positioning as described above, the required even heating of the casting container head 30*a* above all in its riser channel area between the piston rod leadthrough bore 31 and the nozzle connection area 32. The depth of the heater bores 36, 37 and, hence, the insertion depth of the heating cartridges 34*a* to 34*d*, is chosen in this example too preferably such that the riser channel area of the casting container head 30*a* can be heated just above the normal or maximum bath level of the melt inside the crucible, or in any event in the area of a crucible cover or just above the latter. Since the heating cartridges 34*a* to 34*d* extend upwards to above the height of the mouthpiece 33, the riser channel area in the casting container top part 30*a* is evenly heated up to the riser channel opening into the nozzle. The heating cartridges 34*a* to 34*d* are connected via connections 40*a* to 40*d* extending at right angles to a suitable voltage/current source, which in turn is connected to a regulation/control unit for regulation or control of the heating capacity.

As is clear from the embodiments shown and described above, the invention provides a metering device for a hot chamber die-casting machine, in which the casting container may be actively heated very evenly in the critical riser channel area above the bath level of the casting melt inside the crucible of the furnace container and up to the opening into the attached nozzle. This is done by arranging one or more heating units internally in the casting container, in particular inside a piston rod leadthrough bore, inside the riser bore itself or inside a specially provided heater receiving space, which can, for example, be designed as a heater bore. When electric resistance heating units are used, such as in the form of heating cylinders or heating cartridges, the heater can be implemented in a particularly compact and small design, which overall favors compact designs of the casting container and the nozzle. The heater compensates for system-related heat losses caused by radiation and heat transmission, in particular at the contact surface of the nozzle with the mould and from the casting container to the furnace/crucible cover and to the casting container holder on the cover.

The use of electric heating units furthermore has the advantage that the heating capacity and heating effect of the latter are comparatively easy to control and, as a rule, manage without expensive and voluminous forced cooling. Depending on application, however, other conventional flameless heating units may be used instead of electric heating units.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A metering device for a hot chamber die-casting machine, comprising:

a casting container attachable to a crucible of the hot chamber die-casting machine and having a riser channel in a riser channel area and a casting piston unit for metered conveying of melt out of the crucible via the riser channel;

a heating device with a flameless heating unit for active heating of at least a part of the riser channel area;

wherein the heating unit is one of: (i) constituted by a hollow cylinder-shaped heating cylinder having a casing on which an electric heating conductor structure is provided and is coaxially inserted in a piston rod leadthrough bore through which a piston rod of the casting piston is passed, (ii) constituted by a hollow cylinder-shaped heating cylinder having a casing on which an electric heating conductor structure is provided and is coaxially inserted to be electrically insulated from the riser channel in a riser bore containing the riser channel, (iii) arranged in a heater receiving space specially provided in the casting container, the heater receiving space being constituted by a conically-shaped heating bore comprising a cylindrical recovery bore of the casting container and an insertion sleeve having a conical inner surface and a cylindrical outer surface so as to be insertable into the receiving bore, and (iv) arranged in a heater receiving space specially provided in the casting container and being constituted by a receiving space provided in a wall of the casting container seperating the riser channel and the piston leadthrough bore and annularly surrounding a corresponding riser portion.

2. The metering device according to claim 1, wherein the heating unit is an electric resistance heating unit.

3. The metering device according to claim 2, wherein a heater bore is provided to act as the heater receiving space.

4. The metering device according to claim 3, wherein the casting container has a crucible-side part that, when the casting container is attached to the crucible, is inside the crucible, and a top part that, when the casting container is attached to the crucible, is outside the crucible, and wherein the heating cylinder extends up to, or in, the crucible-side part of the casting container and/or extends in the top part of the casting container at least up to the maximum height distance of the riser channel from the crucible-side part of the casting container.

5. The metering device according to claim 4, wherein the piston rod leadthrough bore receiving the heating cylinder, the riser bore, or the heater bore, is of a conical form and the heating cylinder is received by an externally conical adapter sleeve and is inserted therewith into the piston rod leadthrough bore, the riser bore, or the heater bore.

6. The metering device according to claim 3, wherein the piston rod leadthrough bore receiving the heating cylinder, the riser bore, or the heater bore, is of a conical form and the heating cylinder is received by an externally conical adapter sleeve and is inserted therewith into the piston rod leadthrough bore, the riser bore, or the heater bore.

7. The metering device according to claim 3, wherein the casing contains a heat-conducting support sleeve that supports the heating conductor structure in an electrically insulating manner.

8. The metering device according to claim 7, wherein the casting container has a crucible-side part that, when the casting container is attached to the crucible, is inside the crucible, and a top part that, when the casting container is attached to the crucible, is outside the crucible, and wherein the heating cylinder extends up to, or in, the crucible-side part of the casting container and/or extends in the top part of the casting container at least up to the maximum height distance of the riser channel from the crucible-side part of the casting container.

9. The metering device according to claim 7, wherein the piston rod leadthrough bore receiving the heating cylinder, the riser bore, or the heater bore, is of a conical form and the heating cylinder is received by an externally conical adapter sleeve and is inserted therewith into the piston rod leadthrough bore, the riser bore, or the heater bore.

10. The metering device according to claim 7, wherein the support sleeve is provided with a thermal insulation on an inner side or outer side.

11. The metering device according to claim 10, wherein the casting container has a crucible-side part that, when the casting container is attached to the crucible, is inside the crucible, and a top part that, when the casting container is attached to the crucible, is outside the crucible, and wherein the heating cylinder extends up to, or in, the crucible-side part of the casting container and/or extends in the top part of the casting container at least up to the maximum height distance of the riser channel from the crucible-side part of the casting container.

12. The metering device according to claim 10, wherein the piston rod leadthrough bore receiving the heating cylinder, the riser bore, or the heater bore, is of a conical form and the heating cylinder is received by an externally conical adapter sleeve and is inserted therewith into the piston rod leadthrough bore, the riser bore, or the heater bore.

13. The metering device according to claim 10, wherein the thermal insulation contains an insulating sleeve of thermally insulating material contacting the support sleeve to form a hollow insulation space.

14. The metering device according to claim 13, wherein the casting container has a crucible-side part that, when the casting container is attached to the crucible, is inside the crucible, and a top part that, when the casting container is attached to the crucible, is outside the crucible, and wherein the heating cylinder extends up to, or in, the crucible-side part of the casting container and/or extends in the top part of the casting container at least up to the maximum height distance of the riser channel from the crucible-side part of the casting container.

15. The metering device according to claim 13, wherein the piston rod leadthrough bore receiving the heating cylinder, the riser bore, or the heater bore, is of a conical form and the heating cylinder is received by an externally conical adapter sleeve and is inserted therewith into the piston rod leadthrough bore, the riser bore, or the heater bore.

16. The metering device according to claim 1, wherein the heating device contains several flameless heating units, of which one each is placed in at least one of the piston rod leadthrough bore, the riser bore, and one or more heater receiving spaces provided specially in the casting container.

17. The metering device according to claim 1, further comprising a nozzle attachable to a connection area of the casting container at which the riser channel opens, wherein the heating device has in addition a flameless heating unit heating the connection area of the casting container from the outside and/or the nozzle from the outside.

* * * * *